US005373998A

United States Patent [19]

Carey-Yard

[11] Patent Number: 5,373,998

[45] Date of Patent: Dec. 20, 1994

[54] CHOPPING DEVICE

[75] Inventor: Andrew Carey-Yard, Leinfelden-Echterdingen, Germany

[73] Assignee: Robert Bosch GmbH, Stuttgart, Germany

[21] Appl. No.: 167,770

[22] Filed: Dec. 15, 1993

[30] Foreign Application Priority Data

Dec. 17, 1992 [DE] Germany ..... 4242640

[51] Int. Cl.[5] ..... B02C 18/22

[52] U.S. Cl. ..... 241/166; 241/235; 241/236; 241/242

[58] Field of Search ..... 241/166, 167, 235, 236, 241/242, 243

[56] References Cited

U.S. PATENT DOCUMENTS

| | | | |
|---|---|---|---|
| 98,757 | 1/1870 | Garretson | 241/236 |
| 1,032,132 | 7/1912 | Gormley | 241/167 |
| 4,401,279 | 8/1983 | Devita et al. | 241/236 |
| 4,410,144 | 10/1983 | Imperi | 241/236 |
| 5,201,475 | 4/1993 | Nakagomi | 241/236 |
| 5,226,607 | 7/1993 | Karg | 241/166 |

FOREIGN PATENT DOCUMENTS 4024060 8/1992 Germany .

*Primary Examiner*—Mark Rosenbaum
*Assistant Examiner*—John M. Husar
*Attorney, Agent, or Firm*—Michael J. Striker

[57] ABSTRACT

The chopping device includes a rotary cutting tool having peripheral cutting teeth with gaps between the teeth, which cooperates with an opposing knife element to chop up a workpiece and a clearing device which enters into the gaps between the teeth during operation to remove chopped up pieces of the workpiece from the gaps. To provide an economical and strong chopping device the opposing knife element and the clearing device are provided with a single rotatably driven counter tool. The single counter tool has a rotation axis parallel to the rotation axis of the cutting tool and displaced radially from it, a rotation direction opposite to that of the cutting tool and a rotation speed which is maintained in a fixed relationship to that of the cutting tool. The counter tool has at least one protruding cutting arm, which is formed so that the cutting arm tip rotates toward a cutting tool tooth and into the gap that proceeds that cutting tool tooth in a cutting tool rotation direction and nearly slides along the contour of cutting tool in that gap.

8 Claims, 2 Drawing Sheets

CHOPPING DEVICE

BACKGROUND OF THE INVENTION

The present invention relates to a chopping device and, more particularly, to a chopping device for chopping garden and/or yard waste into pieces.

A known chopping device has a rotary cutting tool having peripheral cutting teeth with gaps between the teeth, which cooperates with an opposing knife element to chop up a workpiece into pieces, and a clearing device which enters into the gaps between the teeth of the cutting tool during operation to remove chopped up material from those gaps.

A known chopping device, particularly for garden waste, which is described in German Patent 40 24 060 C2, has a cutting tool in the form of a cutting roller located at the lower end of a feed shaft provided with an input funnel above the cutting tool. The cross section of the cutting roller corresponds approximately to the lower cross section of the feed shaft. A stationary opposing knife element is provided next to the cutting roller on a bar inclined downwardly from the periphery of the cutting roller, so that a cutting edge having an angular cross section results. The bar is adjustably mounted on a crossbeam of the device. A clearing device cooperates with the cutting roller to clear and free gaps between the teeth of the cutting roller, in which chopped up material passing the opposing knife element is caught, of that chopped up material. The clearing device comprises a reciprocating slider member axially extending over the entire length of the cutting roller, which is driven in synchronization with the passing gaps between the cutting teeth of the rotating cutting roller. The free end of the sliding member is bevelled so that a tooth-like point of engagement is formed on it which enters the gaps. The sliding member is located on the side of the feed shaft opposite or remote from the opposing knife and is reciprocated in operation by engagement with a cam of the drive shaft for the rotating cutting roller.

SUMMARY OF THE INVENTION

It is an object of the present invention to provide a chopping device which is stronger, more economical and easier to assemble than the prior art chopping device.

These objects and others which will become more apparent hereinafter are attained in a chopping device comprising a rotary cutting tool having peripheral cutting teeth with gaps between the teeth, which cooperates with an opposing knife element to chop up a workpiece, and a clearing device which enters into the gaps between the teeth during operation to remove chopped up pieces of the workpiece from the gaps.

According to the invention, the opposing knife element and the clearing device are provided in a single rotatably driven counter tool. This single counter tool has a rotation axis parallel to the rotation axis of the cutting tool and displaced radially from it, a rotation direction opposite to that of the cutting tool and a rotation speed which is maintained in a fixed relationship to that of the cutting tool. The counter tool has at least one protruding cutting arm, which is formed so that the cutting arm tip rotates toward a cutting tool tooth and into the gap preceding that cutting tool tooth in the cutting tool rotation direction and nearly slides along a contour surface of the cutting tool in the gap into which it rotates.

The chopping device according to the invention has the advantage that it is simpler to assemble or construct than that of the prior art. It is also considerably stronger and more economical. The opposing knife element and the clearing device are provided in a single component, the so-called counter tool, which performs both functions. The counter tool is rotationally symmetric in a preferred embodiment and can be easily manufactured. It is rotatably driven so that the comparatively weak and troublesome device for converting a rotary motion into a reciprocating slider motion, as in the chopping device of the prior art described in the background section, is not part of the apparatus of the invention. Despite the use of a single component for both the clearing device and the opposing knife element the workpiece or goods to be chopped up are cut up in a reliable manner and the gaps between the teeth of the cutting tool are reliably cleared. After regrinding the cutting tool a readjustment of the counter tool is not required. A helical gear drive at the cutting tool can be used to obtain the necessary power transmission and a reduction of the bearing forces.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENT

Figure 1:
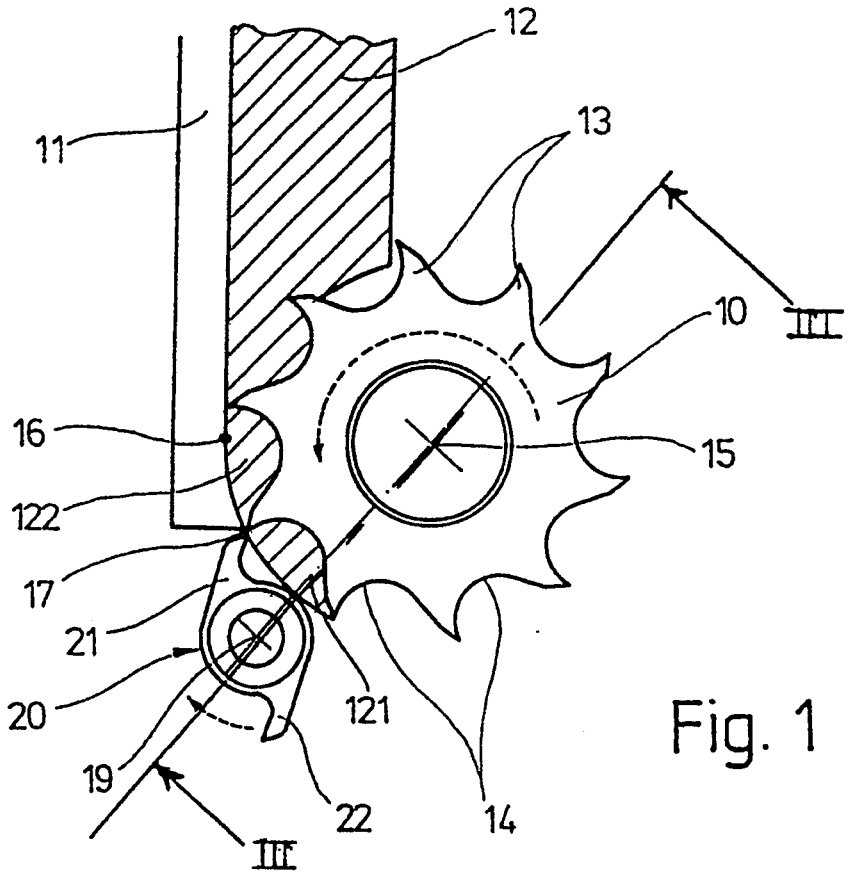
FIG. 1 is a cross-sectional action view through a chopping device according to the invention showing the cooperation of the counter tool with the cutting tool prior to cutting the workpiece.
Figure 2:
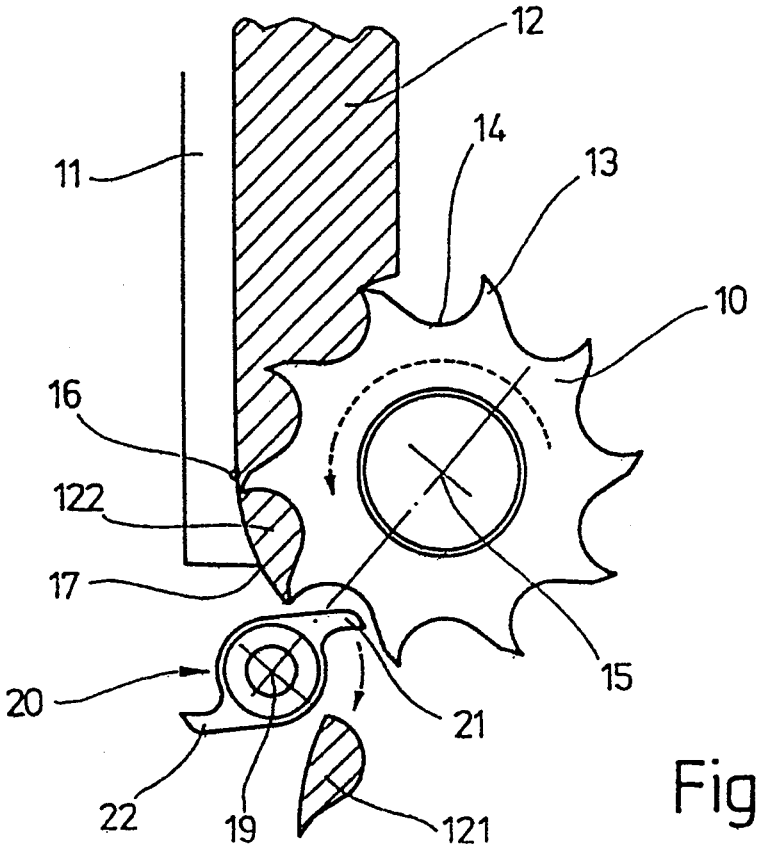
FIG. 2 is another cross-sectional action view through the chopping device of FIG. 1 after cutting the workpiece.

Only a lower portion of an embodiment of the chopping device according to the invention, or a chip making machine, is shown in FIG. 1 and 2. The chopping device has a roller-like cutting tool 10 in a lower section of a feed shaft, of which only a left side wall is shown, namely bearing wall 11 for the workpiece or goods 12 to be chopped up. The workpiece 12 is pressed against this bearing wall 11, when the cutting tool bites into it. The rotating cutting tool 10 has a plurality of peripheral cutting teeth 13 distributed uniformly around its circumference and the cutting teeth 13 and gaps 14 between them alternate with each other around the periphery of the cutting tool 10. Both the cutting teeth 13 and the gaps 14 extend over the entire axial length of the cutting tool 10. The rotation axis 15 of the cutting tool 10 is substantially perpendicular to the drawing plane. The rotation axis 15 of the cutting tool 10 is positioned relative to the cutting tool 10 so that the bearing wall 11 is approximately tangential to the cutting tool 10. The tangent point or tangent line running perpendicular to the drawing .plane is indicated with reference number 16. A curved portion of the bearing wall 11 extends along a line 17 running down from tangent line 16 and extends perpendicular to the drawing plane and parallel to the rotation axis 15 of the cutting tool 10 in the same manner as the tangent line 16. The radius of curvature of the arc-shaped curved portion of wall 11 extending along the curve line 17 is slightly greater than the radius of the circle described by the tips of the cutting tool teeth 13 and has the same center point.

For keeping the workpiece against the cutting tool 10 so that it can be chopped up and for cleaning the gaps 14 between the teeth of material deposited there after passing through the cutting tool a rotatably driven counter tool 20 is provided, which extends axially parallel to the rotation axis 15 of the cutting tool 10 and is rotatably mounted about a rotation axis 19 displaced radially from the rotation axis 15. The rotation direction of the counter tool 20 is thus opposite to the rotation direction of the cutting tool 10 and the rotation speed of the counter tool 20 maintains a fixed relationship to the rotation speed of the cutting tool 10. The relationship is dependent on the structure of the counter tool and the cutting tool and is explained in more detailed hereinbelow.

The counter tool 20 has two protruding cutting arms 21,22, which are diametrically opposite to each other on the cutting tool 20 and extend axially over the entire axial extent of the cutting tool 10 and/or the counter tool 20. The cutting arms 21,22 are formed so that they rotate in succession into successive gaps 14 between the teeth 13 of the cutting tool 10. Each cutting arm tip rotates toward the tip of a cutting tooth 13 and into a gap between the cutting teeth 13 preceding the cutting tool tooth 13 toward which that cutting arm tip rotates and nearly slides along the contour surface of the cutting tool in the gap 14 into which it rotates. The front boundary surfaces of the cutting arms 21, 22 in the rotation direction of the counter tool 20 have a somewhat arc-shaped contour and the rear boundary surfaces have a somewhat planar tangential shape. The cutting arms 21,22 have tips which are tooth-like and point in the rotation direction of the counter tool and the tooth shape of the cutting arm tip is similar to that of the cutting teeth 13 of the cutting tool 10.

Figure 3:
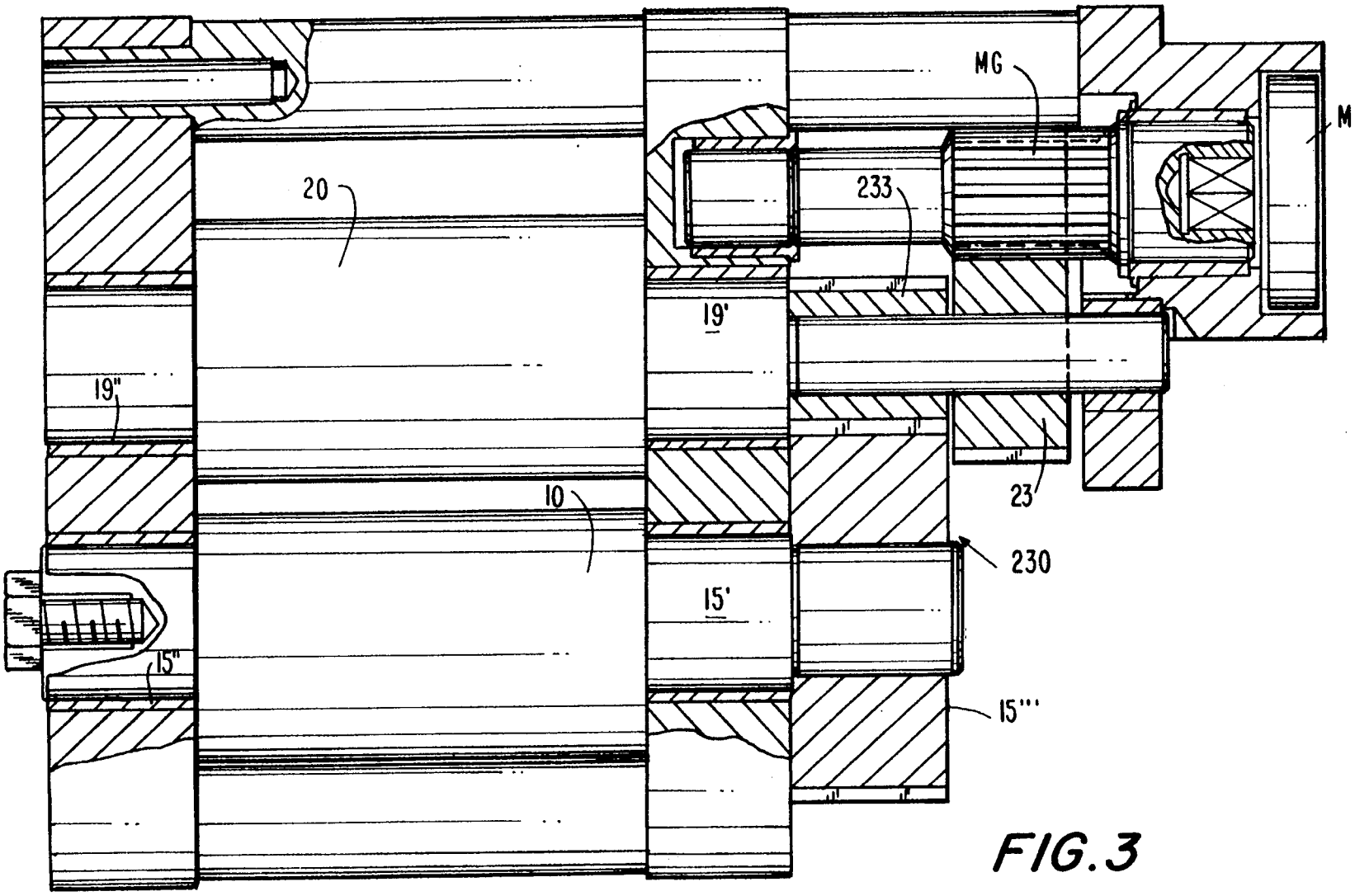
FIG. 3 is a cross-sectional view through the drives for the counter tool and cutting tool shown in FIG. 1 taken along the section line III—III in FIG. 1.

The rotation speed of the counter tool 20 with both cutting arms 21, 22 is z/2 times greater than that of the cutting tool 10, where z is the number of cutting teeth 13. In the present embodiment the cutting tool 10 has ten cutting teeth 13 so that the rotation speed of the counter tool 20 is five times that of the cutting tool 10. The drive 210 for the cutting tool 10 and the counter tool 20 is shown in FIG. 3. The drive 220 for the counter tool 20 is thus derived from the drive 210 for the cutting tool 10 by using a transmission or gear unit 230 with a conversion of 5:1 from the cutting tool drive. The counter tool 20 is mounted on a counter tool shaft 19' held in bearing 19'' and the cutting tool 10 is mounted on cutting tool shaft 15' engaged in bearing 15''. A common motor M is connected with the gear unit 230 which comprises the clearing input gear 231 mounted on the counter tool shaft 19' and engaged with the motor output gear MG and clearing output gear 233 also mounted on counter tool shaft 19' but also engaged with the tool gear 15''' attached to the cutting tool shaft 15' so the counter tool and cutting tool are driven in opposite directions with the appropriate gear ratio. The counter tool can also have only one or three or four cutting arms in other embodiments. Its rotation speed is then z/n times larger than the rotation speed of the cutting tool 10, where n is the number of cutting arms on the counter tool. During rotation of the cutting tool 10 and the counter tool 20 the tips of the cutting arms 21 and 22 and the tips of the cutting teeth 13 are on the line 17 at their point of closest approach to each other. This line 17 also runs along the curved portion of the bearing wall 11.

In operation, the workpiece 12 fed into the feed shaft for processing is engaged by the front side of the cutting teeth 13 and pulled in. Thus the workpiece 12 is pressed against the bearing wall 11, which functions also as a feed wall. Simultaneously the workpiece 12 is held reliably against the bearing wall 11. This holding effect prevents noisy impacts and makes the cutting of the workpiece in cooperation with the counter tool 20 in the vicinity of curved line 17 easier. The gaps 14, in which the cut away elements or pieces 121, 122 are received on passing the curved line 17, are cleared and kept free by the cutting arms 21 and 22 of the counter tool 20 functioning as clearing device. As seen in FIG. 1 and 2, after cutting away the piece 121 of the workpiece 12 the tip of the cutting arm 21 passes a cutting tooth tip of the cutting tool 10 and into the gap 14 preceding the cutting tooth tip in the rotation direction of the cutting tool ! 0 and pushes out the piece 121 from the gap 14 (FIG. 2). The cutting arm 21 of the counter tool 20 next separates the next piece 122 in cooperation with the following cutting tooth 13 and clears it from the next gap 14 in the same way as previously described. The counter tool 20 is freed by the cutting tool 10 of workpiece material.

While the invention has been illustrated and described as being embodied in a chopping device, particularly a chopping device for garden and yard waste, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. Chopping device for chopping up a workpiece, said chopping device comprising a rotatable cutting tool having an outer periphery, a cutting tool rotation axis and a plurality of peripherally disposed cutting teeth distributed around said outer periphery with gaps between said cutting teeth; a rotatable counter tool having a counter tool rotation axis positioned adjacent said rotatable cutting tool so that said counter tool rotation axis is substantially parallel to said cutting tool rotation axis and displaced radially from said cutting tool rotation axis, said counter tool providing means for cooperating with said rotatable cutting tool in operation to chop pieces from said workpiece placed in the vicinity of said cutting tool and means for clearing said gaps of said pieces of said workpiece caught between said cutting teeth; and means for rotating said counter tool in a rotation direction opposite to a rotation direction of said cutting tool and at a rotation speed bearing a fixed relationship to a rotation speed of said cutting tool, wherein said counter tool has two diametrically opposed protruding cutting arms, each of said cutting arms having a cutting arm tip and said cutting arms being formed so that the cutting arm tip rotates successively toward each of the cutting teeth and into said gap preceding said cutting tooth toward which said cutting arm tip rotates in said rotation direction of said cutting tool and nearly slides along a contour surface of said cutting tool in said gap into which said cutting arm tip rotates and so that said cutting arms rotate successively into successive ones of said gaps following each other in said rotation direction of said cutting tool.

2. Chopping device as defined in claim 1, wherein said cutting arm tip is shaped like a tooth and points in said rotation direction of said cutting arm.

3. Chopping device as defined in claim 2, wherein said cutting arm tip is shaped like said cutting tooth of said cutting tool.

4. Chopping tool as defined in claim 1, wherein said counter tool has curved boundary surfaces facing in said rotation direction of said counter tool and approximately planar tangential boundary surfaces facing in a direction opposite to said rotation direction of said counter tool.

5. Chopping tool as defined in claim 1, further comprising means for driving said counter tool rotatably at a rotation speed z/2 times greater than a rotation speed of said cutting tool, where z is a total number of said cutting teeth on said cutting tool.

6. Chopping tool as defined in claim 1, wherein said cutting .tool and said counter tool are shaped like rollers and said counter tool extends axially over a total axial length of said cutting tool.

7. Chopping tool as defined in claim 6, further comprising a bearing wall for said workpiece extending tangentially to said cutting tool and against which said workpiece is pressed on engagement with said cutting teeth of said cutting tool in operation, and said bearing wall extends around said cutting tool along a surface, said surface extending axially parallel to said cutting tool rotation axis and said counter tool rotation axis and said tips of said counter tool and said cutting tool approaching closest to each other along said surface during rotation of said cutting tool and said counter tool.

8. Chopping tool as defined in claim 7, wherein said bearing wall is planar except in a curved end region on a lower side of a point of tangency of said bearing wall with said cutting tool, said curved end region having a curvature radius equal to a radius of a circular path along which said cutting tooth tips move during rotation of said cutting tool.

* * * * *